US012053086B2

(12) United States Patent
Wimbauer, II

(10) Patent No.: US 12,053,086 B2
(45) **Date of Patent: *Aug. 6, 2024**

(54) SUSPENDED PULL-OUT CABINET ORGANIZER DRAWER

(71) Applicant: Charles Joseph Wimbauer, II, Ravenswood, WV (US)

(72) Inventor: Charles Joseph Wimbauer, II, Ravenswood, WV (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/115,507

(22) Filed: Feb. 28, 2023

(65) Prior Publication Data

US 2023/0200533 A1 Jun. 29, 2023

Related U.S. Application Data

(63) Continuation of application No. 17/353,111, filed on Jun. 21, 2021, now Pat. No. 11,589,677.

(60) Provisional application No. 63/041,968, filed on Jun. 21, 2020.

(51) Int. Cl.
*A47B 88/43* (2017.01)
*A47B 88/969* (2017.01)

(52) U.S. Cl.
CPC ..... *A47B 88/969* (2017.01); *A47B 88/43* (2017.01)

(58) Field of Classification Search
CPC ..... A47B 88/43; A47B 88/969
USPC ..... 312/334.23, 334.24, 334.25, 334.26
See application file for complete search history.

(56) References Cited

U.S. PATENT DOCUMENTS

| | | | | |
|---|---|---|---|---|
| 2,948,578 | A * | 8/1960 | Himelreich | A47B 88/487 312/334.26 |
| 4,199,200 | A * | 4/1980 | Livingston | A47B 88/407 384/19 |
| 5,570,941 | A * | 11/1996 | Rock | A47B 88/43 312/334.6 |
| 6,659,576 | B1 * | 12/2003 | Welch | A47B 88/43 312/334.41 |
| 7,810,890 | B2 * | 10/2010 | Klein | A47B 88/483 312/334.32 |
| 9,756,941 | B1 * | 9/2017 | Rowland | A47B 88/427 |
| 2019/0174919 | A1 * | 6/2019 | Greenwood | A47B 88/407 |

* cited by examiner

*Primary Examiner* — James O Hansen
(74) *Attorney, Agent, or Firm* — K&L Gates LLP

(57) ABSTRACT

A suspended pull-out cabinet organizer assembly includes: a front mounting bracket including a front facing flange and a first support arm and a second support arm; a rear mounting bracket including a rear mounting face, a first mounting arm, and a second mounting arm; a pair of drawer slides spanning the front mounting bracket and the rear mounting bracket, each drawer slide including at least two mounting tabs; and an organizer including a series of at least two mounting bosses corresponding to each mounting tab on the first drawer slide and the second drawer slide, wherein the organizer is mounted to the first drawer slide and the second drawer slide by securing each mounting tab to a corresponding mounting boss.

18 Claims, 17 Drawing Sheets

SUSPENDED PULL-OUT CABINET ORGANIZER DRAWER

CROSS-REFERENCE TO RELATED APPLICATIONS

This application comprises a continuation of U.S. patent application Ser. No. 17/353,111 filed Jun. 21, 2021, now U.S. Pat. No. 11,589,677 issued Feb. 28, 2023, which incorporates by reference and claims the benefit of priority to U.S. Provisional Patent Application Ser. No. 63/041,968 filed on Jun. 21, 2020, the entire disclosure of which is hereby incorporated by reference.

TECHNICAL FIELD

The present subject matter relates generally to a suspended pull-out cabinet organizer assembly. Specifically, the present subject matter provides a pull-out cabinet organizer assembly that can be retrofit into any standard kitchen cabinet by securing to the cross-rail and back panel of the cabinet. The organizer enables the use of a variety of drawer configurations to further customize its utility.

BACKGROUND

Currently, there are a number of solutions for suspending an organizer in a cabinet. For example, some of these solutions suspend a trash can from a structure spanning between the front and the rear of the cabinet. Other solutions suspend one or more rails between a pair of drawer slides, the rail providing hooks from which to hang cookware. These solutions, in particular, fail to use all of the space in the cabinet in an efficient manner.

Other solutions attempt to use plastic extrusions to guide and support a tray within a cabinet. However, the plastic extrusions that support the tray do not allow full access to the content of the tray and the tray easily slides out of the extrusions and falls on the floor. Additionally the extrusions must be mounted to a full shelf, as the extrusions themselves are too insubstantial to mount only at the front and back of the cabinet.

Still, other solutions seek to use a partial extension that is friction slide mounted in the center of the cabinet. However, the single rail allows the suspended organizer to wiggle and, the manner in which it is constructed, does not allow full access to all of the organized items.

None of the known teachings provide a solution that makes efficient use of the space within the cabinet, provides a securely mounted organizational structure, and is capable of easy installation in a variety of cabinet sizes.

Accordingly, there is a need for a suspended pull-out cabinet organizer that makes efficient use of the space within the cabinet, provides a securely mounted organizational structure, and is capable of easy installation in a variety of cabinet sizes, as shown and described herein.

SUMMARY

To meet the needs described above, the present subject matter provides a suspended pull-out cabinet organizer assembly that makes efficient use of the space within the cabinet, provides a securely mounted organizational structure, and is capable of easy installation in a variety of cabinet sizes. Various examples of the suspended pull-out cabinet organizer assembly are provided in the descriptions herein.

It can be desirable to have an extra drawer or shelf in a kitchen cabinet to store and organize common kitchen items that take up valuable space in other areas of the kitchen, such as the countertop, upper cabinets, or drawers. It is desirable to have this drawer or shelf placed in an ergonomic position. Still, further, it is desirable for the organizer drawer to be installed in an otherwise unused space in the existing cabinet. The disclosed suspended pull-out cabinet organizer assembly advantageously fills these needs and addresses the aforementioned deficiencies by providing an organizer (e.g., a drawer or a shelf) that is suspended in the open area in the middle of the base cabinet just below the existing drawer, but above the storage space on the floor or shelves behind the door, an area that is currently under-utilized in many kitchen cabinets.

Disclosed is a suspended pull-out cabinet organizer assembly including (i) a front bracket, including an installation flange, attached to (ii) a pair of telescoping drawer slide members that are substantially parallel to each other and attached to (iii) a rear mounting bracket, and (iv) an organizer in the form of a drawer, a shelf, or a similar organizational structure that is supported by and spans the drawer slide members.

The suspended pull-out cabinet organizer assembly may also include one or more of the following additional features and functions. (i) An additional drawer suspended below the primary drawer from an extension of the front and rear supports. (ii) A rear mounting bracket with elongated holes for depth adjustment of the drawer slides. (iii) A height adjustable rear bracket in which a group of vertically aligned and/or elongated holes are used to adjust the back of the unit up or down. (iv) A rear bracket with horizontally elongated holes to help adjust the position of the unit to the left or right. (v) A height adjustable front bracket in which a series of vertically aligned and/or elongated mounting holes are used to raise or lower the drawer. (vi) A depth adjustable front bracket including a horizontal flange that is adjustably mounted to move the whole unit in or out of the cabinet. (vii) A lift out, removable organizer drawer. (viii) One or more stackable organizers mating with organizer drawer. (ix) A top organizer drawer that slides back into the cabinet to expose a bottom organizer drawer. (x) Riveted or welded connection between the brackets and the drawer slides. (xi) A cooperating system of support tabs, mounting bosses, and mounting pins used to index the drawer with respect to the slide tabs. (xii) Cross rails, such as rods, flat straps or other material spanning the drawer slides. (xiii) Organizer drawers made from wood, plastic, or other suitable material. (xiv) A rear bracket that wraps around the drawer slide members with a series of mounting holes that enable some degree of depth adjustment. (xv) A rear mounting bracket including a flange upon which the drawer slides rest. (xvi) Flip out organizer trays mounted on parallel bars like those found in a tackle box or a tool box, either parallel or perpendicular to the direction of travel of the drawer. (xvii) Elongated holes in the telescoping slide members that allow depth adjustments for the rear bracket. (xviii) Threaded holes in the rear bracket to screw the drawer slide to the bracket. (xix) Indexing tabs protruding forward from the front mounting bracket to index the bracket to the bottom of the face frame cross rail. (xx) Additional dividers, sections, compartments, or other organizational features within the drawer. (xxi) A width adjustable front mounting bracket that attaches to the cabinet side walls for cabinets that don't have a face frame cross rail.

In some markets, for example in Europe, kitchen base cabinets are less likely to include a front face cross rail to which to attach the suspended pull-out cabinet organizer assembly. In these instances, it may be advantageous to include a width adjustable front mounting bracket that attaches to the cabinet side walls. In such an example, the front mounting bracket may include telescoping flanges on each of the left and right side of the front mounting bracket to expand or contract the mounting width of the assembly. For example, the telescoping flanges may extend from left and right support arms that attach the front mounting bracket to the drawer slides. Each telescoping flange may include a mounting plate/face that is to be secured to the cabinet side wall and a telescoping arm/rail to expand and contract the width that the front mounting bracket spans within the cabinet.

The suspended pull-out cabinet organizer assembly is unique when compared with other known devices and solutions because it provides: (i) an ergonomic way to organize the middle portion of a standard kitchen base cabinet, while retaining the existing function of the lower portion of the cabinet; (ii) an additional space, hidden behind a cabinet door, for discreetly storing items normally stored on the countertop or in another drawer; (iii) full access and full visibility to the items being organized and stored; and (iv) easy assembly and installation.

The suspended pull-out cabinet organizer assembly is unique in that it is structurally different from other known devices or solutions. More specifically, the device is unique due to the presence of the following features and functions: (i) depth adjustment of the drawer slides using elongated holes in the telescoping slide members; (ii) the fasteners are tightened from the inside of the frame of the drawer slides which provides easier access and easier installation; (iii) a gang of three mounting bosses molded into the bottom of the drawer or shelf and spaced at ⅜", or 8 mm, to facilitate mounting in a cabinet to align with the three common ways a door is installed on a cabinet face frame: overlay, ⅜" inset, and full inset; (iv) a front mounting flange that allows fastening to the back of the face frame cross rail and does not obstruct the door opening; (v) a frame that incorporates the telescopic drawer slides as a structural component and additionally requires only a front and rear mounting bracket for installation, assembly, and adjustability; (vi) interchangeable frame components and organizer drawers that fit the modular suspended frame structure, to reduce manufacturing and inventory complexity; (vii) a molded handle that can be accessed from both the top and bottom of the organizer; (viii) a molded handle that can also be used as organizer space; and (ix) a suspended slide-out frame for organizer drawers that easily installs in a kitchen base cabinet.

In a primary embodiment described herein, the suspended pull-out cabinet organizer assembly includes the following components: (i) a zinc-plated steel front mounting bracket including three elongated holes in a front facing flange, the front mounting bracket further including two indexing tabs adjacent to the front facing flange and two threaded holes in each of a left and right downward facing support arm; (ii) a pair of zinc-plated steel, full-extension, ball bearing telescopic drawer slides, each drawer slide including a cabinet member, an intermediate member, and a drawer member, the two drawer slides being arranged substantially parallel to each other, each of the drawer slides including two holes at the front of the cabinet member for mounting to the front mounting bracket, two elongated holes at the rear of the cabinet member for mounting to a rear mounting bracket, and three mounting tabs with holes for securing a drawer member; (iii) a rear mounting bracket including a rear mounting face including three elongated holes and two forward facing mounting arms, each of the mounting arms including two threaded holes for mounting the drawer slides; (iv) an organizer, such as a drawer or tray or the like, made of molded plastic mounted to the drawer slides.

In the primary embodiment described above, the components are connected as follows. The front two holes of the left and right drawer slides are screwed to the two threaded holes in the corresponding downward facing support arms of the front bracket. The rear of the left and right drawer slides are screwed through the elongated holes at the rear of the drawer slides into the threaded holes in the corresponding left and right forward facing mounting arms of the rear mounting bracket. The organizer drawer or tray rests on the mounting tabs on the drawer slides and is secured in place with screws passing through the holes in the mounting tabs into mounting bosses molded into the plastic drawer or tray. A series of mounting bosses is provided at each mounting location to enable the drawer or tray position to be adjusted to fit more appropriately in the cabinet in which it is mounted. The elongated holes in the rear of the drawer slides allow depth adjustability for mounting in various cabinet depths and the elongated holes in the front and rear mounting brackets allow for left and right adjustment when mounting to the cabinet. The preferred plastic for the molded drawer or tray is a compound of polycarbonate and acrylonitrile butadiene styrene, also known as PC-ABS.

An example of a suspended pull-out cabinet organizer assembly includes: a front mounting bracket including a front facing flange and a first support arm and a second support arm, wherein the first support arm and the second support arm are located on opposing sides of the front facing flange, wherein the front facing flange includes two or more mounting holes; a rear mounting bracket including a rear mounting face, a first mounting arm, and a second mounting arm each of the first mounting arm and the second mounting arm extending from the rear mounting face towards the front mounting bracket, the rear mounting face including at least two mounting holes; a first drawer slide spanning the front mounting bracket and the rear mounting bracket, wherein the first drawer slide includes a front end and a rear end, wherein the front end of the first drawer slide is secured to the first support arm of the front mounting bracket and the rear end of the first drawer slide is secured to the first mounting arm of the rear mounting bracket, the first drawer slide including at least two mounting tabs; a second drawer slide spanning the front mounting bracket and the rear mounting bracket, wherein the second drawer slide includes a front end and a rear end, wherein the front end of the second drawer slide is secured to the second support arm of the front mounting bracket and the rear end of the second drawer slide is secured to the second mounting arm of the rear mounting bracket, the second drawer slide including at least two mounting tabs; and an organizer including a series of three mounting bosses corresponding to each mounting tab on the first drawer slide and the second drawer slide, wherein the organizer is mounted to the first drawer slide and the second drawer slide by securing each mounting tab to a corresponding mounting boss.

The two or more mounting holes in the front facing flange may include three horizontally elongated mounting holes. The front mounting bracket may further include two indexing tabs adjacent to and extending in front of the front facing flange. The first support arm and the second support arm of the front mounting bracket may extend downward below a bottom surface of the front facing flange. The first support arm and the second support arm of the front mounting bracket may each include two threaded holes for being secured to the drawer slides.

The first drawer slide and the second drawer slide may each be full-extension, ball bearing telescopic drawer slides. The first drawer slide and the second drawer slide may each include a cabinet member, an intermediate member, and a drawer member. The first drawer slide and the second drawer slide may each include two mounting holes at a front of the cabinet member for mounting to the first support arm and the second support arm of the front mounting bracket. The first drawer slide and the second drawer slide may each include two mounting holes at a rear of the cabinet member for mounting to the first mounting arm and the second mounting arm of the rear mounting bracket. The two mounting holes at the rear of the cabinet member may be horizontally elongated for adjusting the lateral position of the cabinet organizer assembly within the cabinet. In some embodiments, the at least two mounting tabs in each of the first drawer slide and the second drawer slide include three mounting tabs.

The rear mounting face including at least two mounting holes may include three horizontally elongated mounting holes. The first mounting arm and the second mounting arm of the rear mounting bracket may each include two threaded holes for mounting to the drawer slides.

The organizer may be a drawer, a shelf, a drink pod organizer including a plurality of holes adapted for receiving objects to be stored in the organizer, etc.

The series of at least two mounting bosses corresponding to each mounting tab may include three mounting bosses for each mounting tab. In some embodiments, each of the mounting bosses in each series of three mounting bosses are spaced ⅜ inches from each adjacent mounting boss. In other embodiments, each of the mounting bosses in each series of three mounting bosses are spaced 8 millimeters from each adjacent mounting boss.

In another example, a suspended pull-out cabinet organizer assembly includes: a front mounting bracket including a front facing flange and a first support arm and a second support arm, wherein the first support arm and the second support arm are located on opposing sides of the front facing flange; a rear mounting bracket including a rear mounting face, a first mounting arm, and a second mounting arm each of the first mounting arm and the second mounting arm extending from the rear mounting face towards the front mounting bracket; a first drawer slide spanning the front mounting bracket and the rear mounting bracket, wherein the first drawer slide includes a front end and a rear end, wherein the front end of the first drawer slide is secured to the first support arm of the front mounting bracket and the rear end of the first drawer slide is secured to the first mounting arm of the rear mounting bracket, the first drawer slide including at least two mounting tabs; a second drawer slide spanning the front mounting bracket and the rear mounting bracket, wherein the second drawer slide includes a front end and a rear end, wherein the front end of the second drawer slide is secured to the second support arm of the front mounting bracket and the rear end of the second drawer slide is secured to the second mounting arm of the rear mounting bracket, the second drawer slide including at least two mounting tabs; and an organizer including a series of at least two mounting bosses corresponding to each mounting tab on the first drawer slide and the second drawer slide, wherein the organizer is mounted to the first drawer slide and the second drawer slide by securing each mounting tab to a corresponding mounting boss.

In light of the present disclosure and the above aspects, it is therefore an advantage of the present disclosure to provide a suspended pull-out cabinet organizer assembly that makes efficient use of the space within the cabinet.

Another advantage of the present disclosure is to provide a suspended pull-out cabinet organizer assembly that securely mounts within a standard kitchen cabinet to provide an organizational structure that makes efficient use of often inefficiently used cabinet space.

It is another advantage of the present disclosure to provide a suspended pull-out cabinet organizer assembly that is capable of easy installation in a variety of cabinet sizes.

It is another advantage of the present disclosure to provide a suspended pull-out cabinet organizer assembly—that supports the use of a wide range of organizational drawer and shelf designs.

Additional features and advantages are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein and it is expressly contemplated to claim individual advantageous embodiments separately. Moreover, it should be noted that the language used in the specification has been selected principally for readability and instructional purposes, and not to limit the scope of the inventive subject matter.

DETAILED DESCRIPTION

The present subject matter provides a suspended pull-out cabinet organizer assembly that makes efficient use of the space within the cabinet, provides a securely mounted organizational structure, and is capable of easy installation in a variety of cabinet sizes. Various examples of the suspended pull-out cabinet organizer assembly are provided in the descriptions herein.

Figure 1:
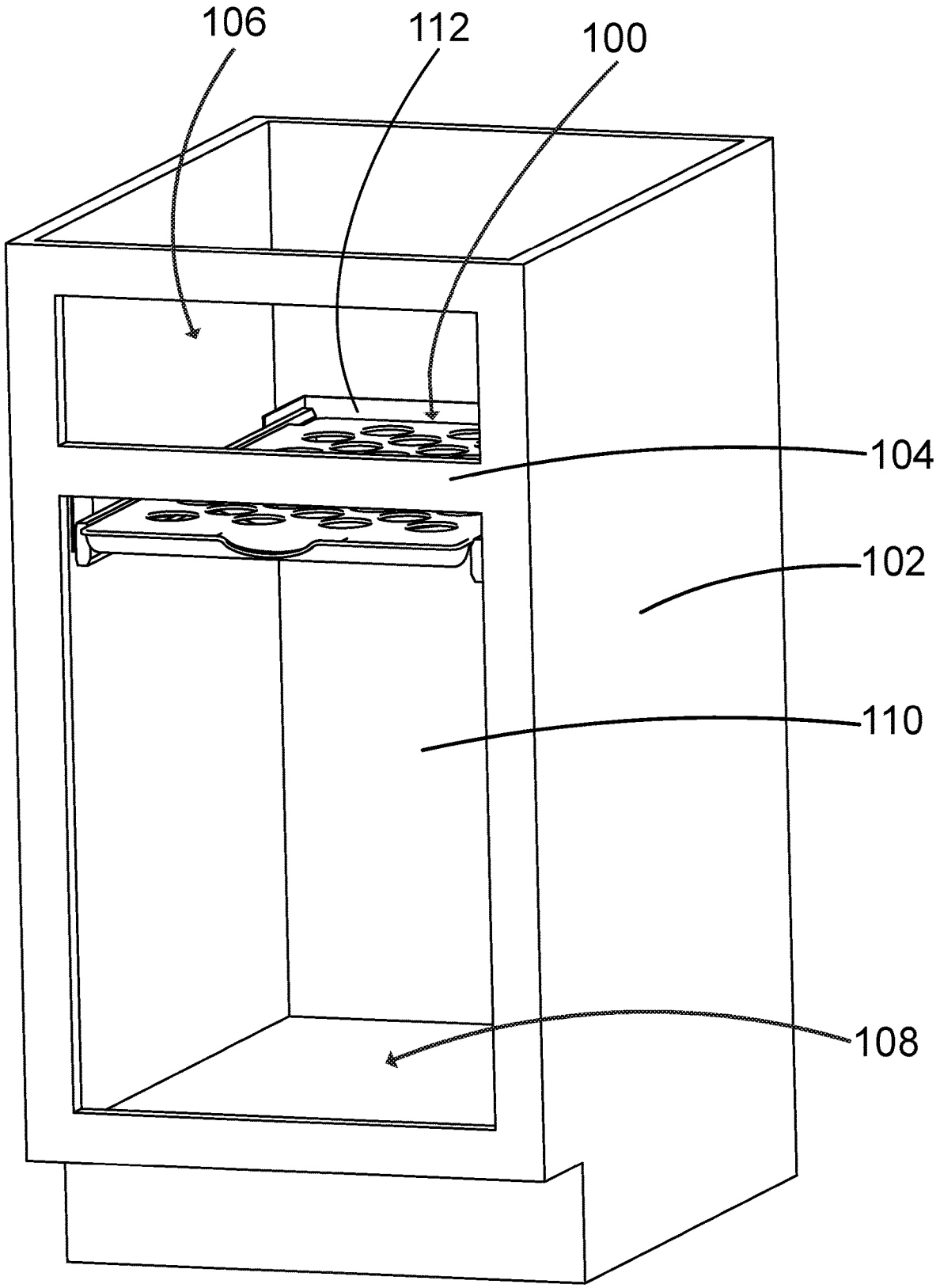
FIG. 1 is a front side perspective view of an example of a suspended pull-out cabinet organizer assembly installed in a standard kitchen cabinet.

FIG. 1 shows a suspended pull-out cabinet organizer assembly 100 installed in a standard kitchen base cabinet 102. The cabinet 102 has its drawer and door removed for a better view of the organizer assembly 100. The organizer assembly 100 is attached to a back of a cabinet cross rail 104 between a drawer opening 106 and a lower door opening 108. In the back, the organizer assembly 100 is suspended and attached to a cabinet back 110. The organizer assembly 100 includes an adjustable depth rear mounting bracket 112, which attaches to the kitchen base cabinet back 110.

Figure 2:
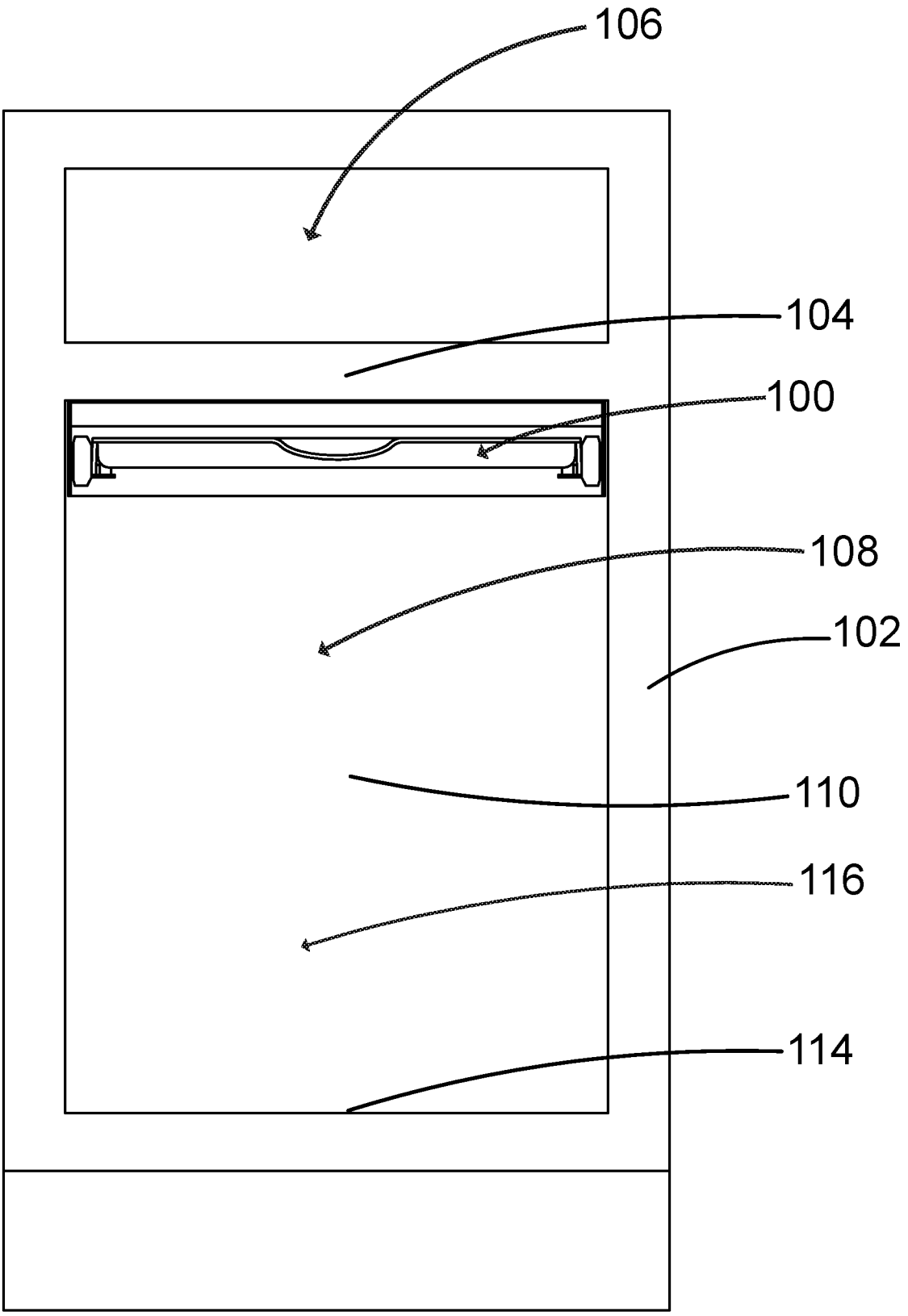
FIG. 2 is a front view of the suspended pull-out cabinet organizer assembly installed in the standard kitchen cabinet shown in FIG. 1.

FIG. 2 shows a front view of the suspended pull-out cabinet organizer assembly 100 in the kitchen base cabinet 102 shown in FIG. 1. FIG. 2 illustrates the limited amount of space the organizer assembly 100 uses at the top of the door opening 108. This allows the floor 114 and lower area 116 of the cabinet 102 to be used in a normal manner.

Figure 3:
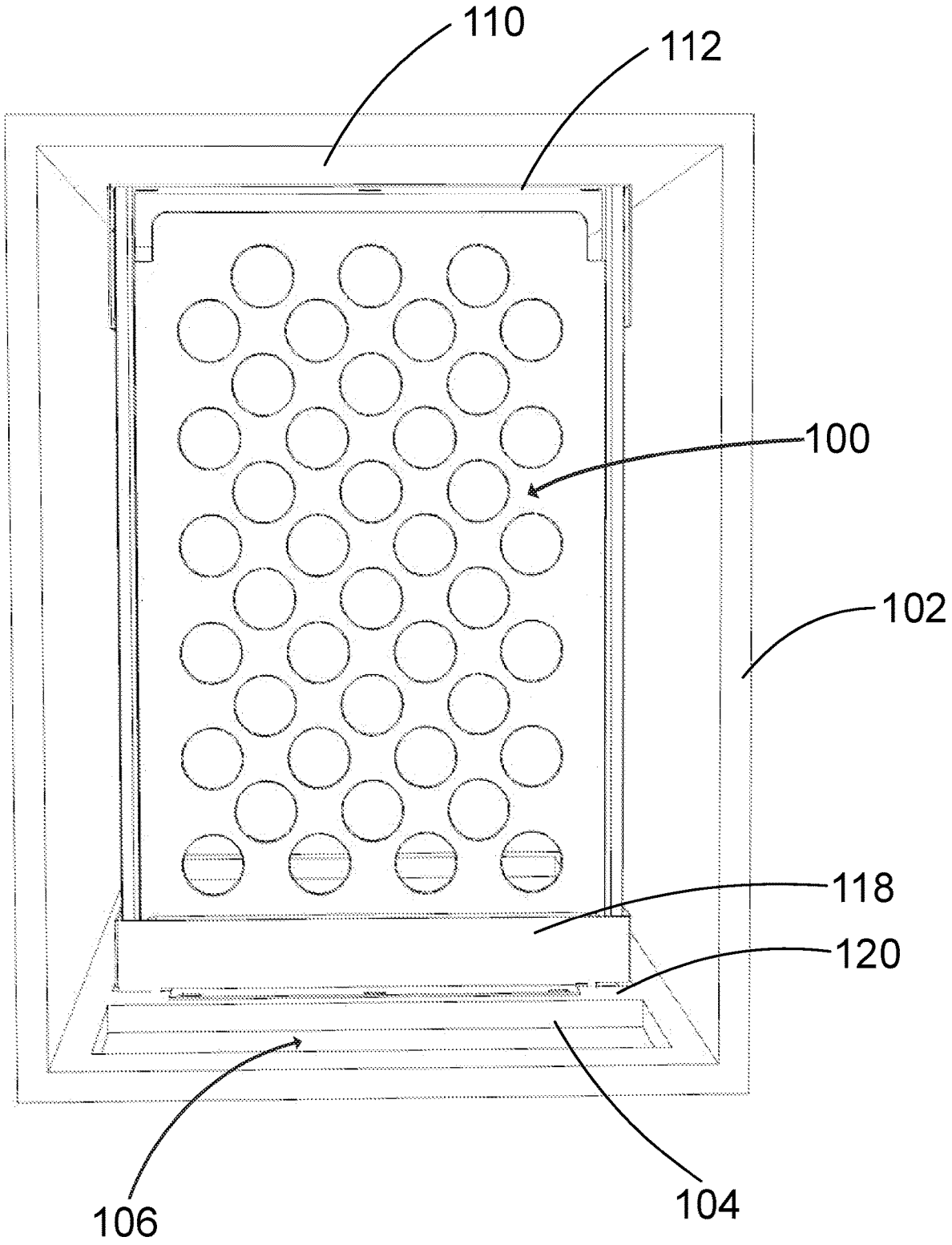
FIG. 3 is a top view of the suspended pull-out cabinet organizer assembly installed in the standard kitchen cabinet shown in FIG. 1.

FIG. 3 is a top side perspective view of the suspended pull-out cabinet organizer assembly 100 in the kitchen base cabinet 102 shown in FIG. 1. As shown, a front mounting bracket 118 attaches to the back 120 of the kitchen base cabinet cross rail 104 and the rear mounting bracket 112 attaches to the kitchen base cabinet back 110.

Figure 4:
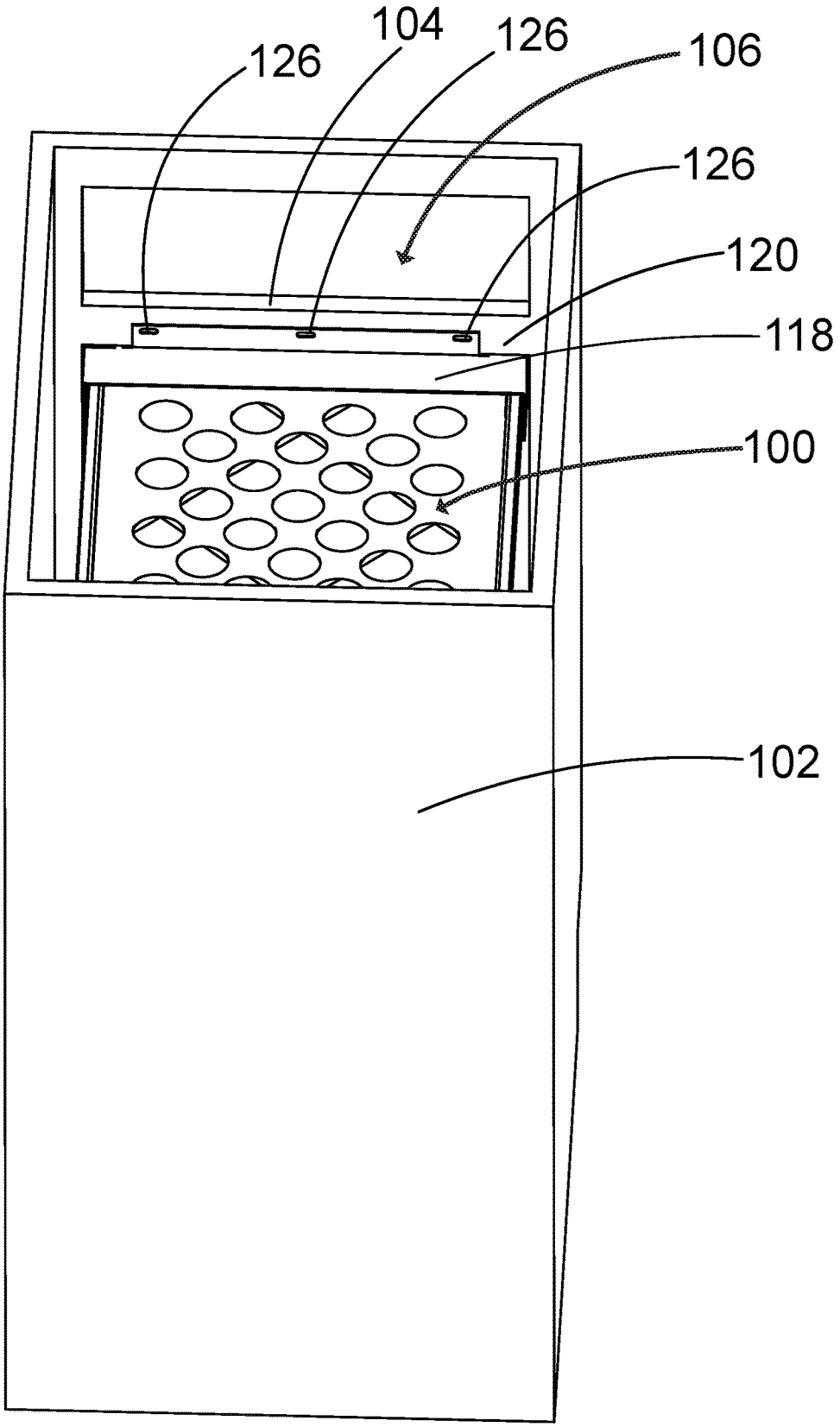
FIG. 4 is a back side perspective view of the suspended pull-out cabinet organizer assembly installed in the standard kitchen cabinet shown in FIG. 1.
Figure 5:
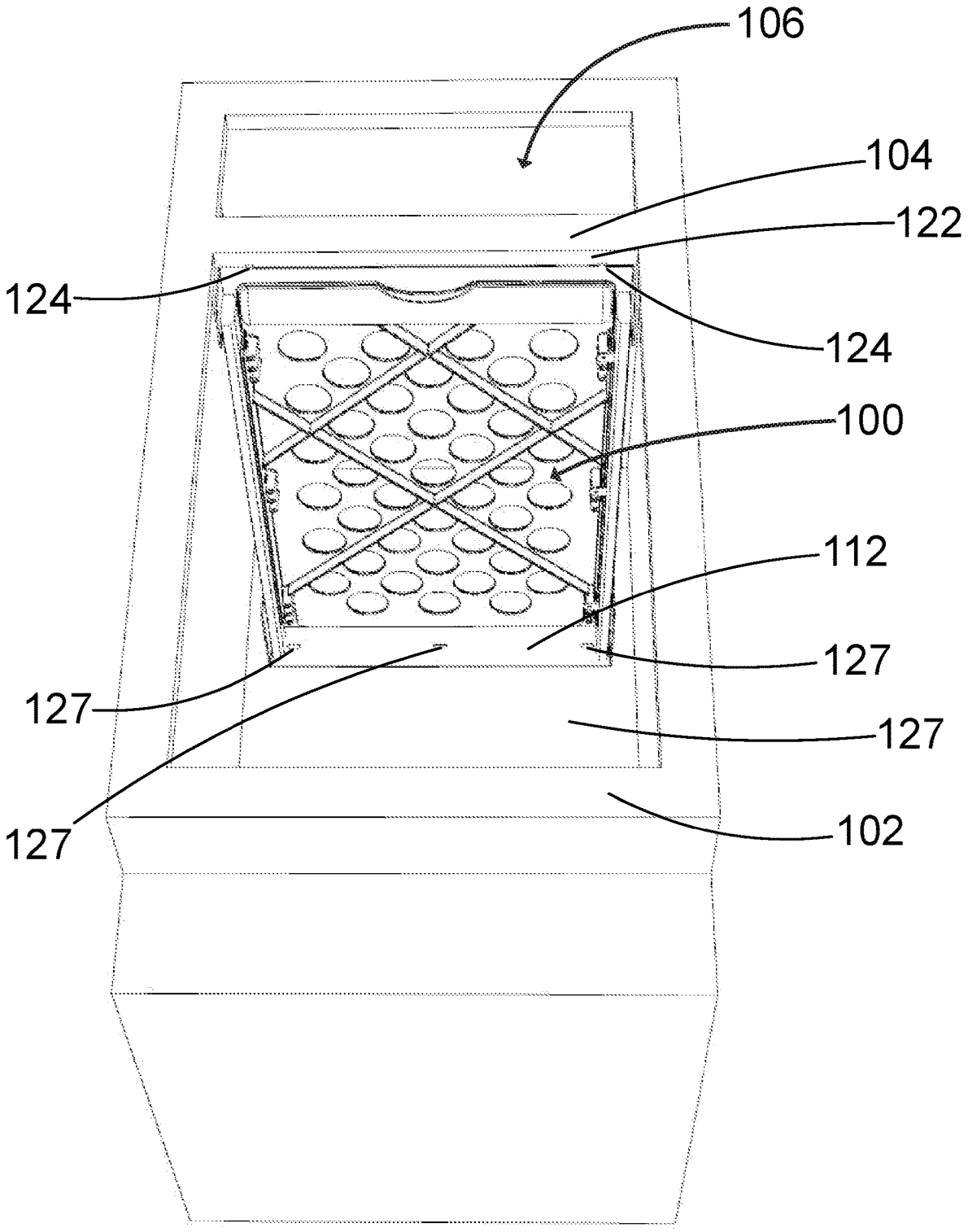
FIG. 5 is a front bottom perspective view of the suspended pull-out cabinet organizer assembly installed in the standard kitchen cabinet shown in FIG. 1.

FIG. 4 is a rear perspective view of the suspended pull-out cabinet organizer assembly 100 in the kitchen base cabinet 102 shown in FIG. 1. FIG. 5 is a front bottom perspective view of the suspended pull-out cabinet organizer assembly 100 in the kitchen base cabinet 102 shown in FIG. 1. FIGS. 4 and 5 help to illustrate the orientation of the front mounting bracket 118 when secured to the cabinet cross rail 104. As shown in FIG. 5, the front mounting bracket 118 is indexed to a bottom of the cross rail 104 via a pair of indexing tabs 124. The front mounting bracket 118 is then screwed to the back of the cabinet cross rail 104 through three elongated holes 126 that provide an opportunity for adjusting the horizontal positon of the organizer assembly 100 during installation, as shown in FIG. 4. Similarly, as shown in FIG. 5, the rear mounting bracket 112 includes three elongated holes 127 for securing the rear mounting bracket 112 to the kitchen base cabinet back 110.

Figure 6:
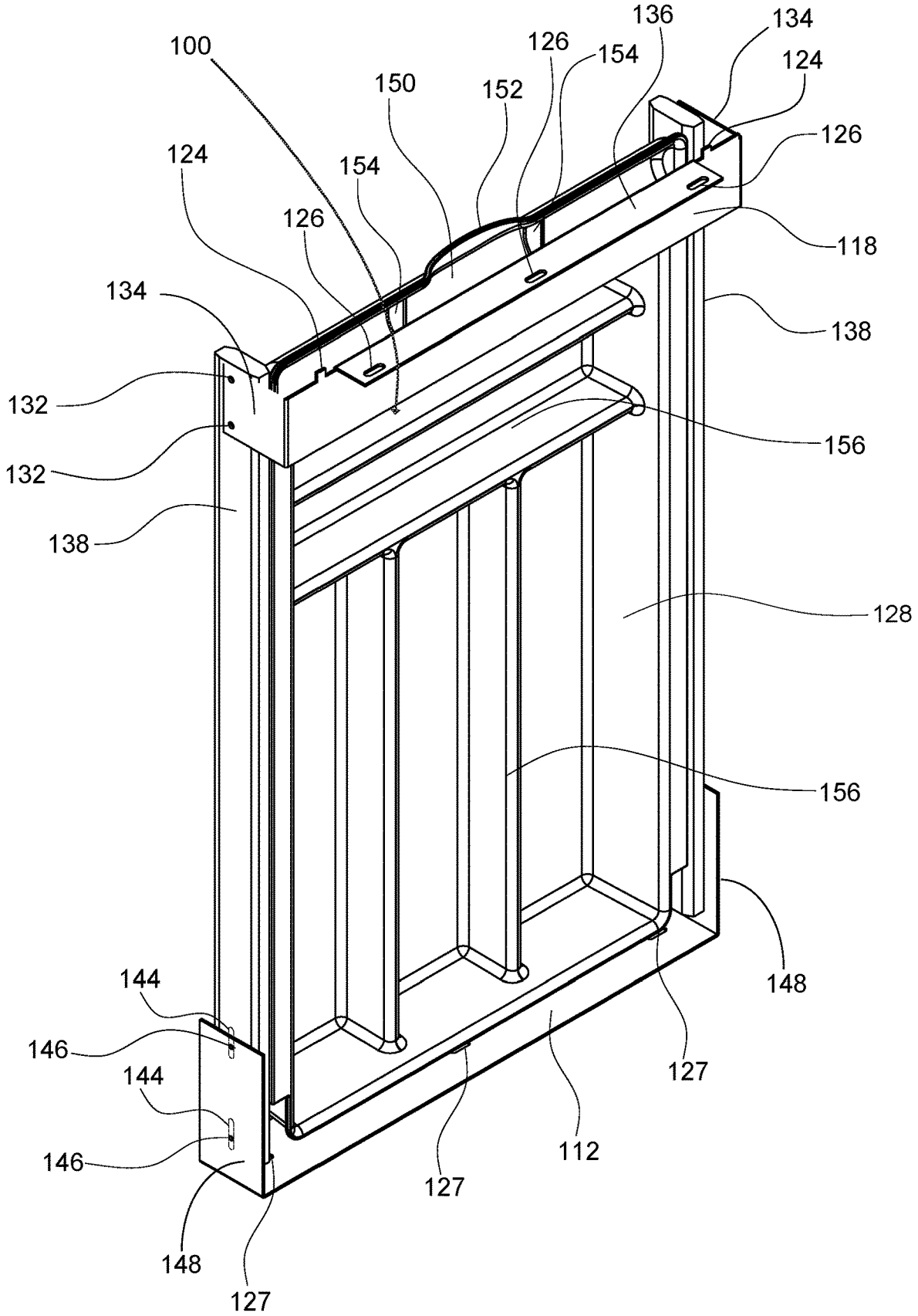
FIG. 6 is a top side perspective view of an example of a suspended pull-out cabinet organizer assembly including a first design of an organizer.

FIG. 6 shows a top side perspective view of an example of a suspended pull-out cabinet organizer assembly 100 including a first design of an organizer 128. As shown in FIG. 6, the organizer assembly 100 includes a flanged front mounting bracket 118, with two threaded holes 132 in each of a first and second side support arm 134, two indexing tabs 124 extending forward from the front of the front mounting bracket 118, and three elongated holes 126 in a front facing flange 136.

FIG. 6 further shows that the organizer assembly 100 includes a pair of telescoping drawer slides 138, each drawer slide 138 includes three mounting tabs 140 (shown in FIGS. 9, 16, and 17) along a drawer member 142 and two mounting holes at the front (not shown because they are covered by the threaded holes 132 in the front mounting bracket 118) that correspond with the threaded holes 132 in the support arms 134 of the front mounting bracket 118. The drawer slides 138 also each include two elongated depth adjustment holes 144 towards the back, which correspond to threaded holes 146 in the mounting arms 148 of the rear mounting bracket 112. The telescopic drawer slides 138 are fastened to front mounting bracket 118 using pan head machine screws threaded into the threaded holes 132 in the support arms 134. The rear mounting bracket 112 is fastened to the telescopic drawer slides 138 using pan head machine screws through the elongated depth adjustment holes 144 into the threaded holes 146 in the mounting arms 148 of the rear mounting bracket 112.

The telescoping drawer slides 138 shown in FIG. 6 are industry standard telescoping drawer slides 138, each including a cabinet member, an intermediate member, and a drawer member. In use, the cabinet member is attached to the front mounting bracket 118 and the rear mounting bracket 112, the drawer member includes the three mounting tabs 140 that attach to the organizer 128, and the intermediate member facilitates the telescoping movement between the cabinet member and the drawer member, as will be recognized by those skilled in the art.

The organizer drawer 128 shown in FIG. 6 includes a number of components that may be common amongst a range of drawer 128 designs. For example, the organizer drawer 128 may include a storage handle 150 and a scooped top access handle 152 flanked by two dividers 154 providing additional drawer space on either side of the top access handle 152. The utility drawer configuration shown in FIG. 6, may include multiple compartment dividers 156.

Figure 7:
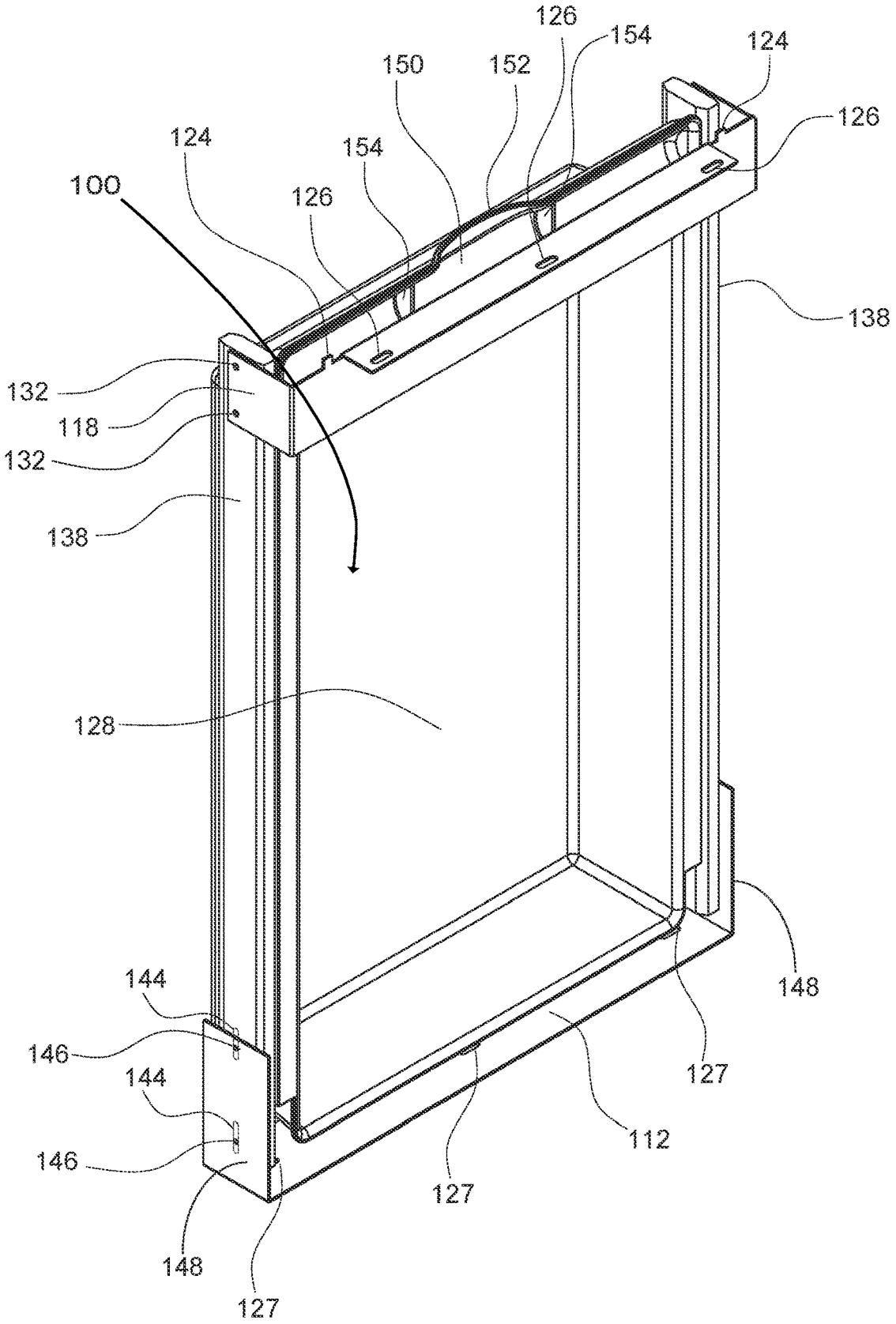
FIG. 7 is a top side perspective view of an example of a suspended pull-out cabinet organizer assembly including a second design of an organizer.

FIG. 7 shows a top side perspective view of an example of a suspended pull-out cabinet organizer assembly 100 including a second design of an organizer 128. In the example shown in FIG. 7, the organizer 128 is a multi-purpose drawer configuration with an open internal structure adapted for general use.

Figure 8:
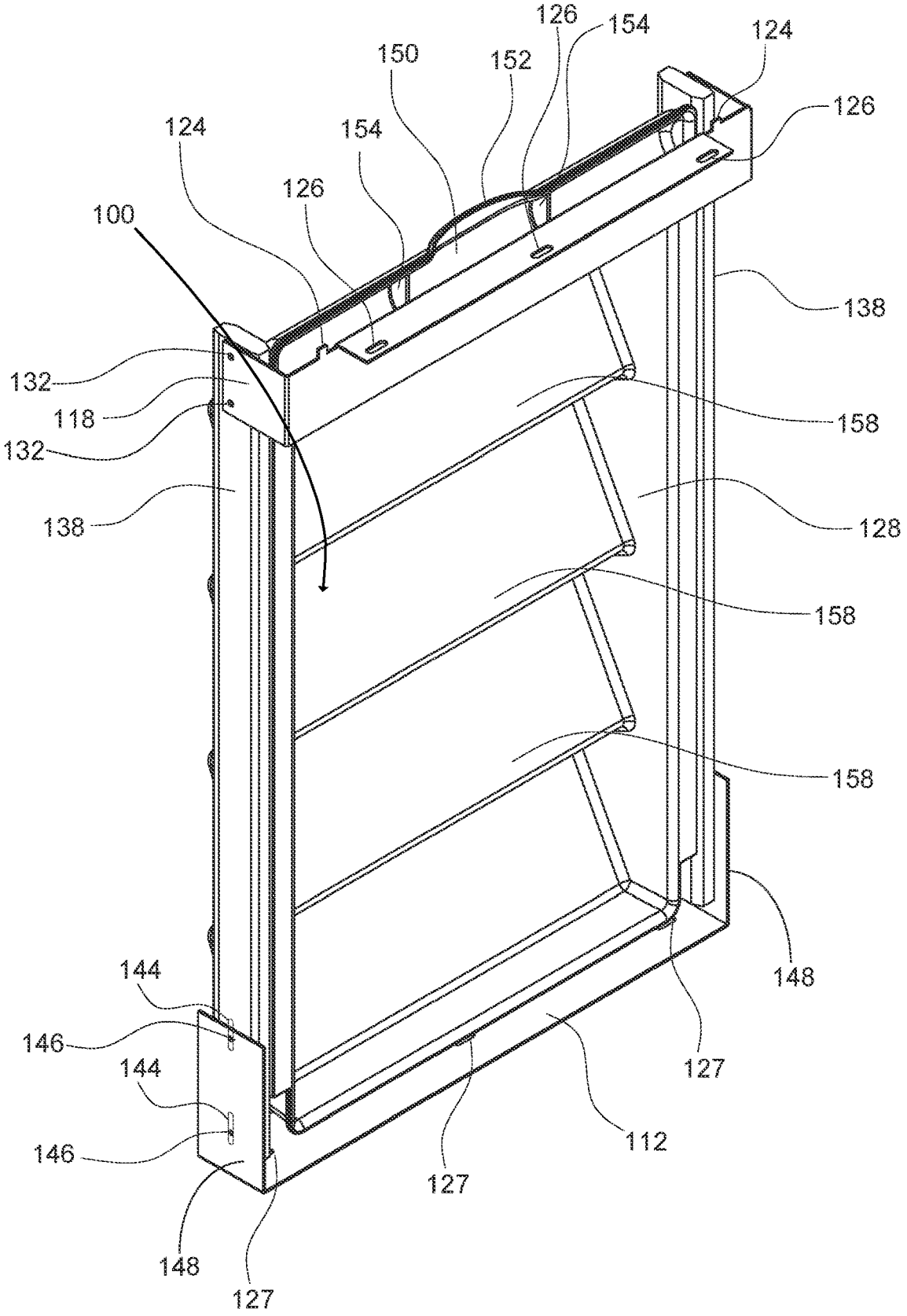
FIG. 8 is a top side perspective view of an example of a suspended pull-out cabinet organizer assembly including a third design of an organizer.

FIG. 8 shows a top side perspective view of an example of a suspended pull-out cabinet organizer assembly 100 including a third design of an organizer 128. In the example shown in FIG. 8, the organizer 128 is a spice bottle organizer configuration including multiple angled risers 158 for spice bottles to rest on in an ergonomic angle, which also allows the spice bottles to overlap to provide more dense storage.

Figure 9:
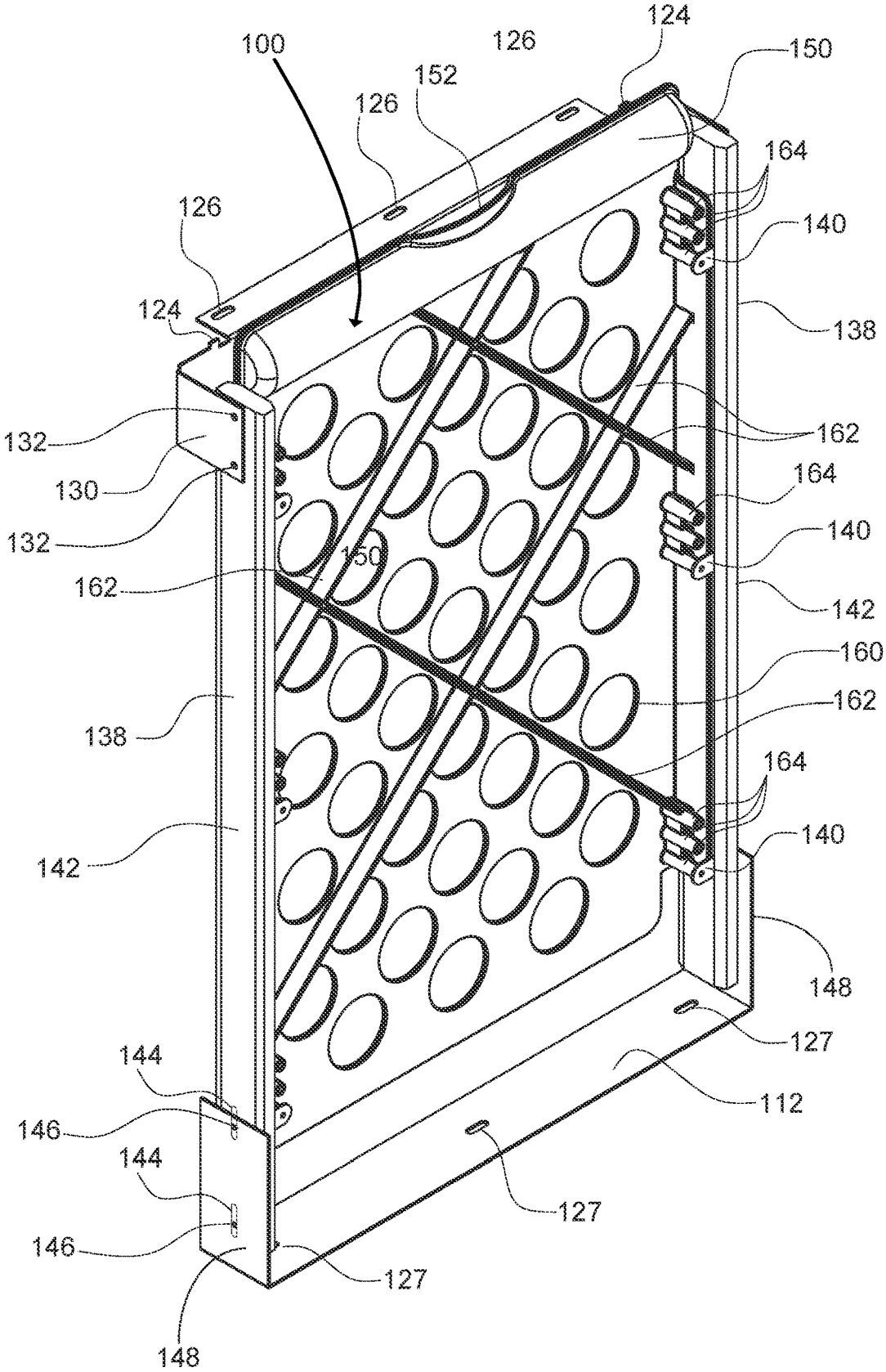
FIG. 9 is a bottom side perspective view of an example of a suspended pull-out cabinet organizer assembly including a fourth design of an organizer.

FIG. 9 shows a bottom side perspective view of an example of a suspended pull-out cabinet organizer assembly 100 including a fourth design of an organizer 128. In the example shown in FIG. 9, the organizer 128 is a coffee and drinks pod organizer configuration including a plurality of storage holes 160 molded into the organizer 128. The storage holes 160 are designed to be smaller in diameter than the upper portion of the drinks/coffee pods to be stored therein such that the upper rim of the pods is elevated above the storage holes 160 to allow easy grasping of the rim to remove the pod from the organizer. In the example of the organizer 128 shown in FIG. 9, the flat nature of drinks pod organizer is given support and rigidity by a number of diagonal ribbed supports 162 to help prevent flexing.

As further shown in FIG. 9, the rear mounting bracket 112 includes three elongated mounting holes 127 that are used to screw the rear mounting bracket 112 to the kitchen base cabinet back 110.

Also, visible in FIG. 9 are the three gangs of three mounting bosses 164 molded into the underside of the organizer 128. The mounting bosses 164, in cooperation with the mounting tabs 140, facilitate both drawer depth adjustment and fastening to the drawer slides 138. For example, the organizer 128 may be mounted more forward or rearward depending on which sets of mounting bosses 164 the mounting tabs 140 are secured. In the example shown in FIG. 9, the mounting tabs 140 are secured to the mounting bosses 164 with pan head screws. The positioning of the organizer 128 using the mounting bosses 164 and the mounting tabs 140 is described in further detail with respect to FIGS. 16 and 17.

Figure 10:
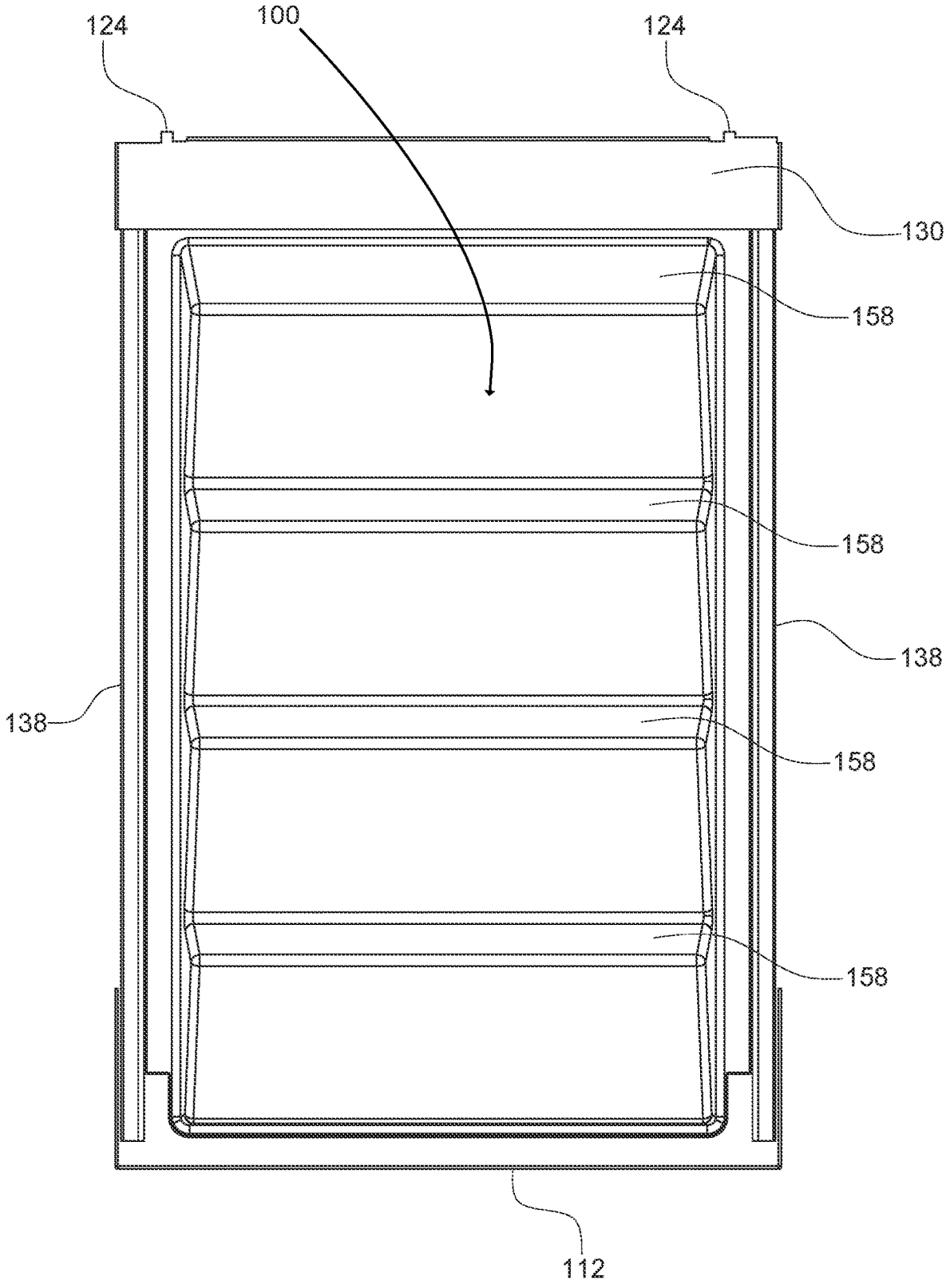
FIG. 10 is a top view of the example of the suspended pull-out cabinet organizer assembly and organizer shown in FIG. 8.

FIG. 10 shows a top view of the example of the suspended pull-out cabinet organizer assembly 100 and organizer 128 shown in FIG. 8. As shown in FIG. 10, the front mounting bracket 118 includes a pair of indexing tabs 124 extending from its front face. The indexing tabs 124 are used, as shown in FIG. 5, to index (i.e., properly seat) the front mounting bracket 118 to the bottom of the cross rail 104.

Figure 11:
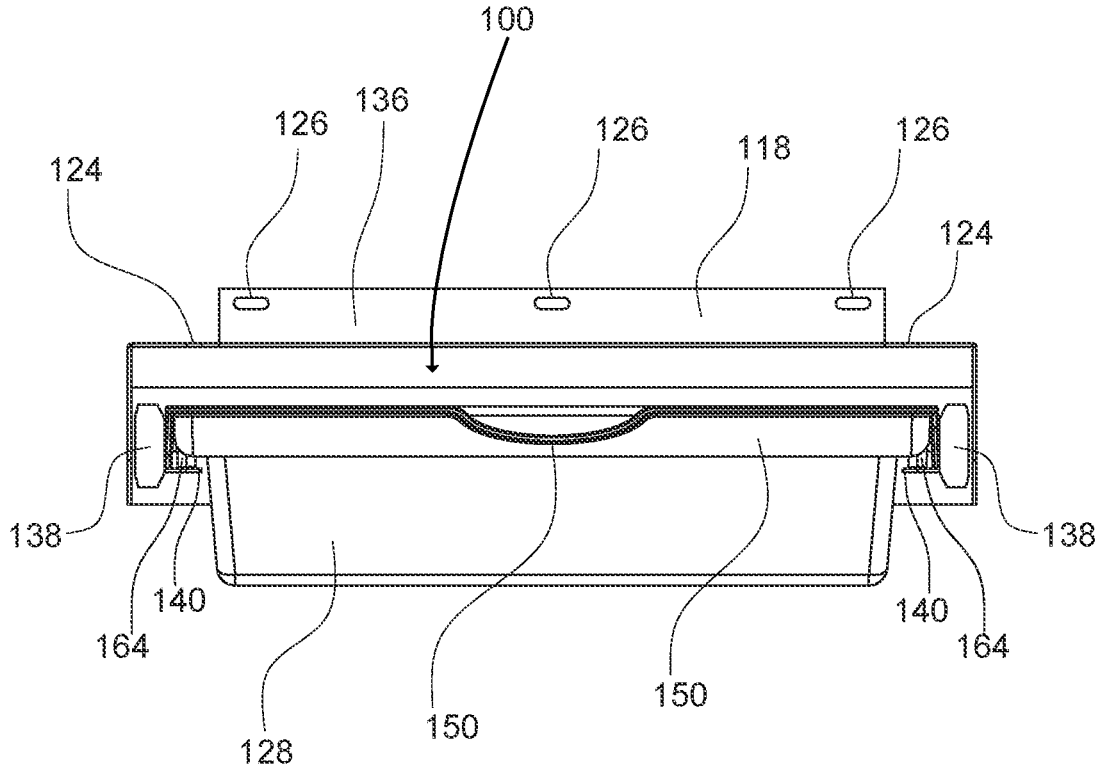
FIG. 11 is a front view of an example of a suspended pull-out cabinet organizer assembly.

FIG. 11 shows a front view of an example of a suspended pull-out cabinet organizer assembly 100. As shown in FIG. 11, the organizer assembly 100 includes the front mounting bracket 118 with the front facing flange 136 including three elongated holes 126 and two indexing tabs 124. The telescoping drawer slides 138 each include three mounting tabs 140. The mounting tabs 140 are screwed into corresponding mounting bosses 164 in the organizer 128. Also molded into the organizer 128 is the top access scooped handle 152 and the organizer bottom handle 150.

Figure 12:
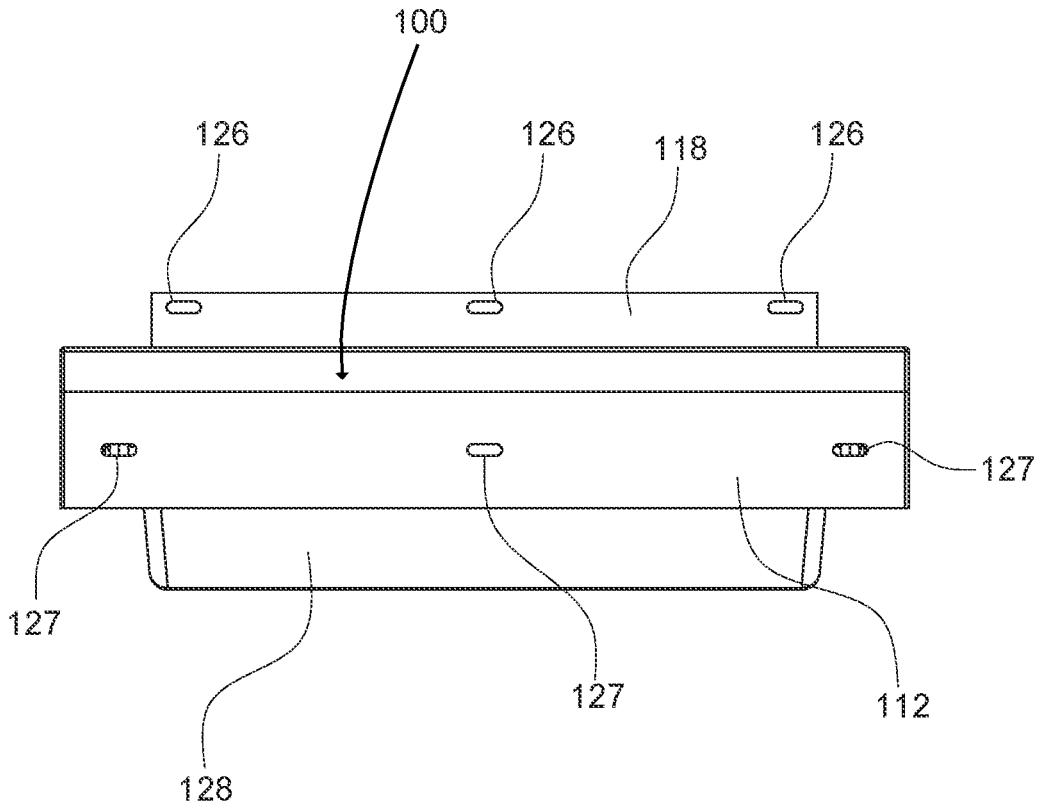
FIG. 12 is a back view of the example of the suspended pull-out cabinet organizer assembly shown in FIG. 11.

FIG. 12 shows a back view of the example of the suspended pull-out cabinet organizer assembly 100 shown in FIG. 11. As shown in FIG. 12, the organizer assembly 100 includes the organizer 128, the front mounting bracket 118 with the front facing flange 136 including three elongated holes 126, and the rear mounting bracket 112 including the three elongated holes 127.

Figure 13:
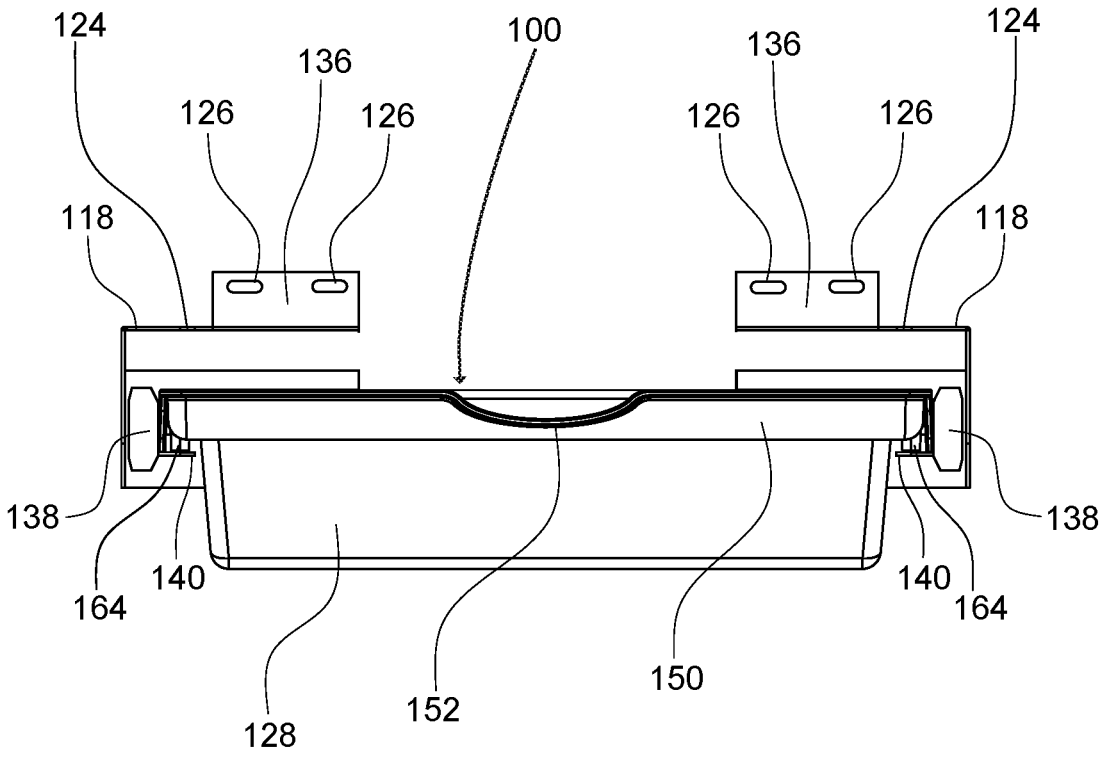
FIG. 13 is a front view of another example of a suspended pull-out cabinet organizer assembly.
Figure 14:
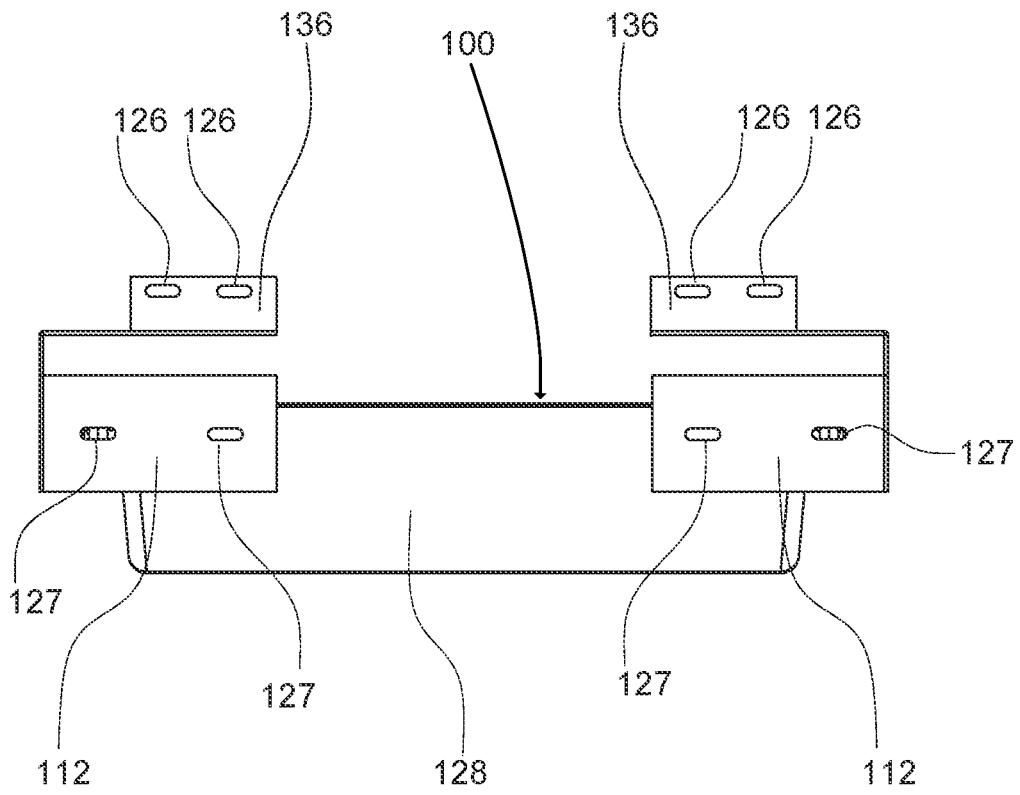
FIG. 14 is a back view of the example of the suspended pull-out cabinet organizer assembly shown in FIG. 13.

FIGS. 13 and 14 show alternative versions of the example of a suspended pull-out cabinet organizer assembly 100 shown in FIGS. 11 and 12, respectively, in which each of the front facing flange 136 and the rear mounting bracket 112 are provided in two segments corresponding to two pairs of elongated holes 126, 127. This configuration may save in both material usage and weight.

Figure 15:
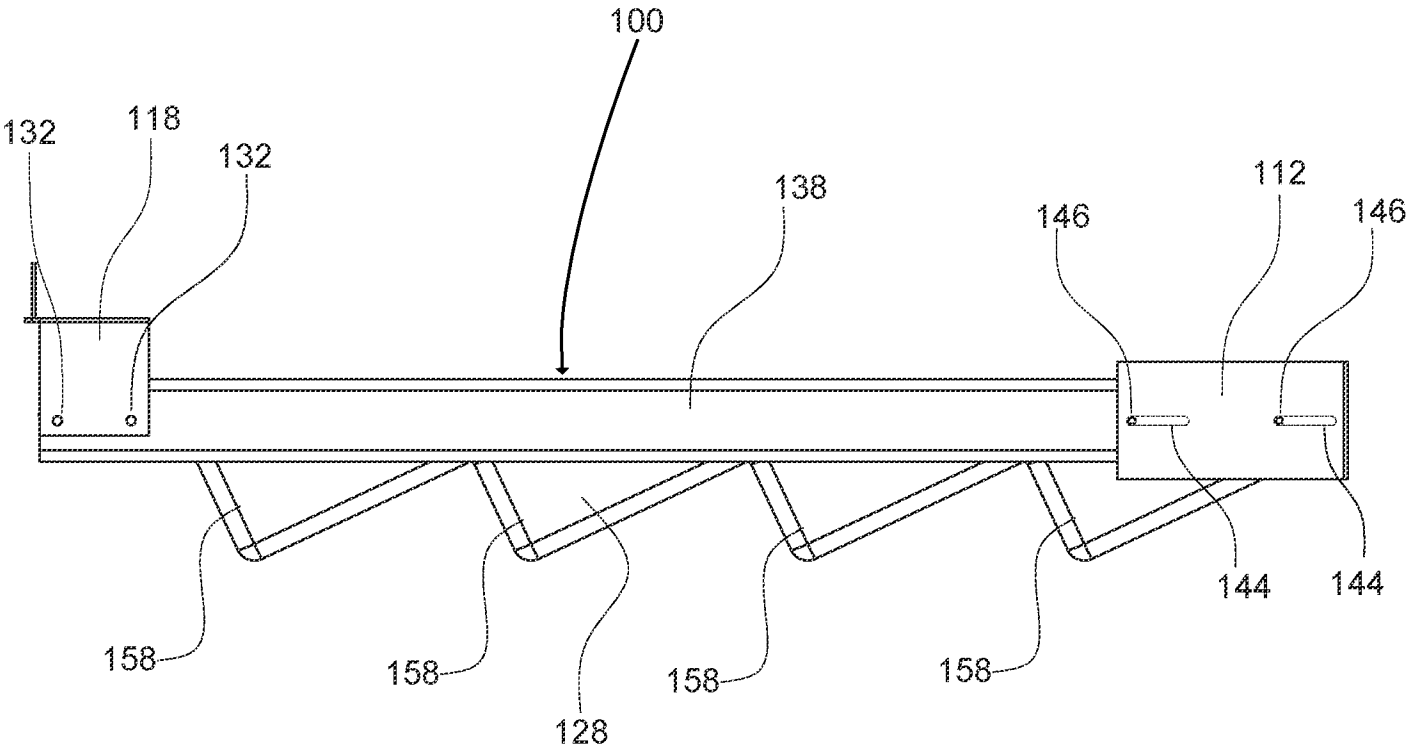
FIG. 15 is a side view of the example of the suspended pull-out cabinet organizer assembly shown in FIG. 8.

FIG. 15 shows a side view of the example of the suspended pull-out cabinet organizer assembly 100 shown in FIG. 8. The left and right sides of the organizer assembly 100 are mirror images of each other.

Figure 16:
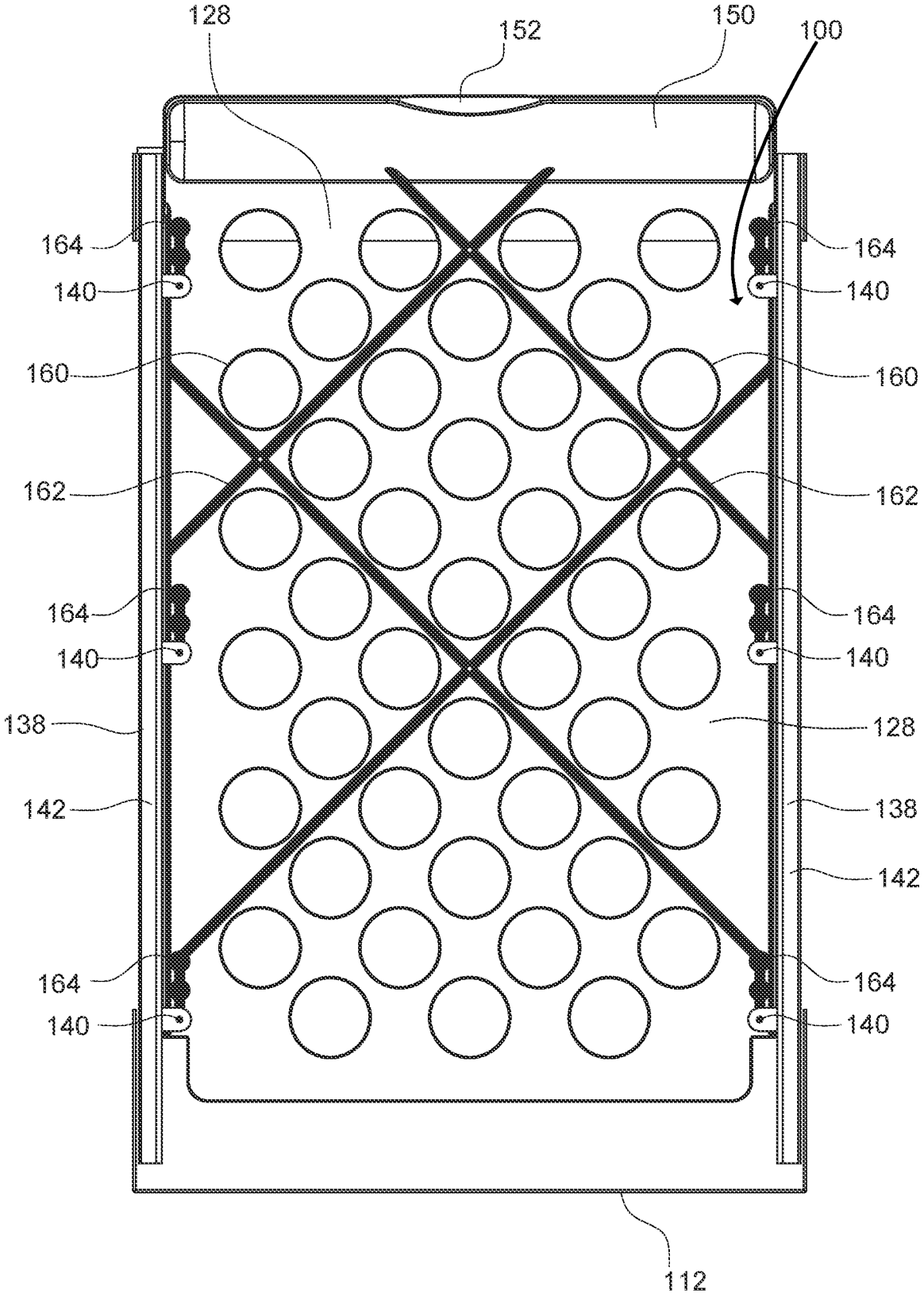
FIG. 16 is a bottom view of the example of the suspended pull-out cabinet organizer assembly shown in FIG. 9.

FIG. 16 shows a bottom view of the example of the suspended pull-out cabinet organizer assembly 100 shown in FIG. 9. FIG. 16 highlights the three gangs of three mounting bosses 164 shown attached to the two sets of three support tabs 140 at the most rearward mounting boss 164. This has the effect of shifting the organizer 128 forward in front of the front of the drawer slides 138 by ¾" or 19 mm. This positioning is designed for face frame cabinets that have full overlay doors that do not protrude into the door opening 108 at all. In FIG. 16, the front of the organizer 128 sits forward of the front ends of the drawer slides 138 by approximately ¾". Attaching the support tabs 140 to the middle boss 164 is the setting for cabinet doors that protrude into the cabinet by ⅜" or 8 mm, also known as ⅜" inset doors.

Figure 17:
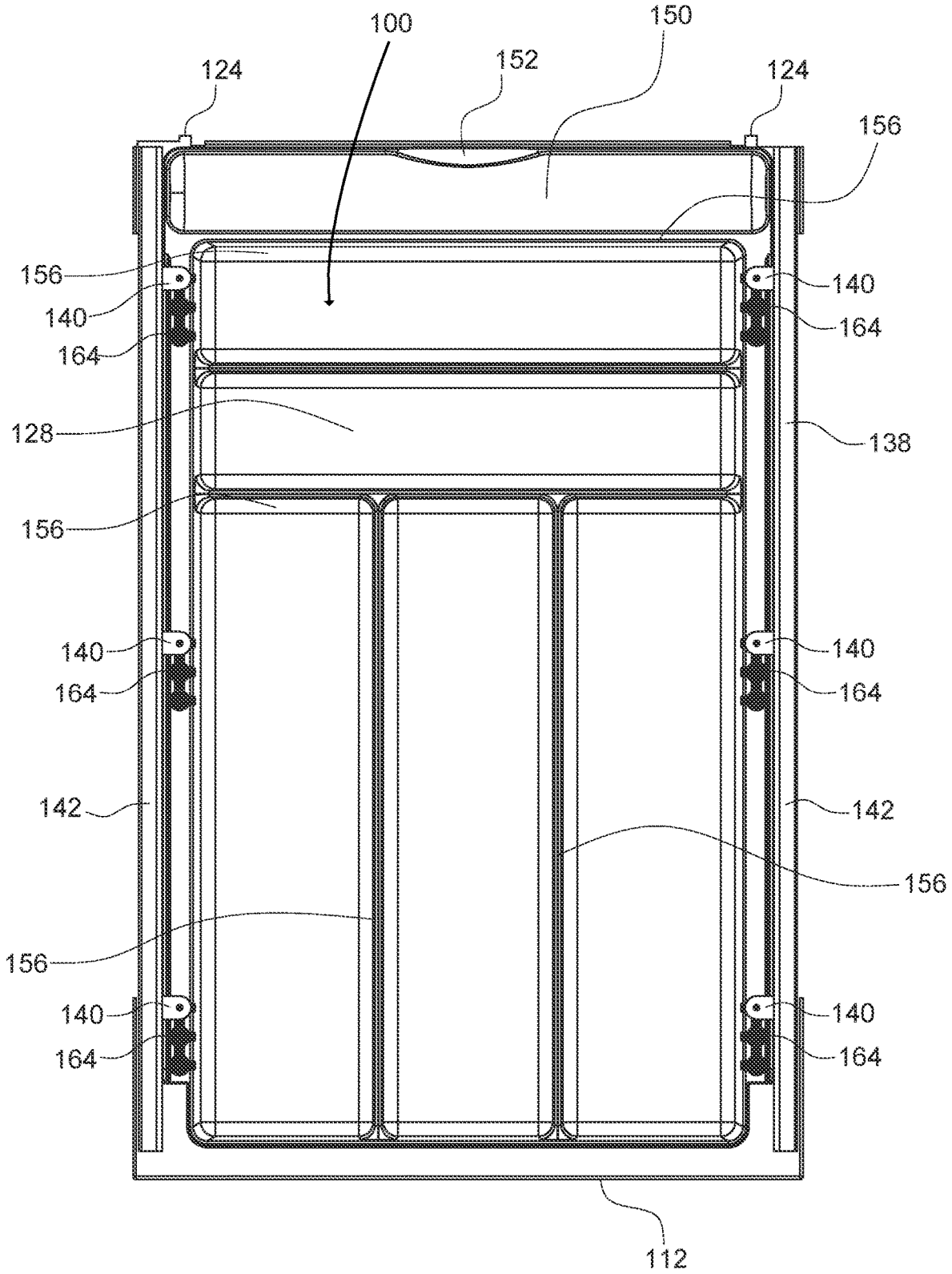
FIG. 17 is a bottom view of the example of the suspended pull-out cabinet organizer assembly shown in FIG. 6.

FIG. 17 shows a bottom view of the example of the suspended pull-out cabinet organizer assembly 100 shown in FIG. 6. In contrast to FIG. 16, FIG. 17 shows that the three gangs of three mounting bosses 164 are shown attached to support tabs 140 at the most forward mounting boss 164. This mounting configuration has the effect of shifting the organizer 128 rearward from the front ends of the drawer slides 138 relative to the other two positions described with reference to FIG. 16. This rearward most positioning is designed for face frame cabinets that have inset doors that are flush with the face frame and completely fill the door opening 108. By shifting the organizer 128 backward, it does not interfere with the cabinet door closing. As shown in FIG. 17, the front of the organizer 128 sits even with the front ends of the drawer slides 138 when the support tabs 140 are mounted to the most forward mounting bosses 164.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A cabinet organizer assembly comprising:

a front mounting bracket including a front facing flange and a first support arm and a second support arm;

a rear mounting bracket including a rear mounting face, a first mounting arm, and a second mounting arm;

a first drawer slide spanning the front mounting bracket and the rear mounting bracket, wherein the first drawer slide includes a front end and a rear end, wherein the front end of the first drawer slide is secured to the front mounting bracket and the rear end of the first drawer slide is secured to the rear mounting bracket;

a second drawer slide spanning the front mounting bracket and the rear mounting bracket, wherein the second drawer slide includes a front end and a rear end, wherein the front end of the second drawer slide is secured to the front mounting bracket and the rear end of the second drawer slide is secured to the rear mounting bracket; and an organizer mounted to the first drawer slide and the second drawer slide, wherein the organizer includes a series of at least two mounting bosses corresponding to a mounting tab on the first drawer slide and a mounting tab on the second drawer slide, wherein the organizer is mounted to the first drawer slide and the second drawer slide by securing each mounting tab to a corresponding mounting boss.

2. The cabinet organizer assembly of claim 1, wherein the front facing flange includes mounting holes, each mounting hole including a horizontally elongated mounting hole.

3. The cabinet organizer assembly of claim 1, wherein the front mounting bracket further includes two indexing tabs adjacent to and extending in front of the front facing flange.

4. The cabinet organizer assembly of claim 1, wherein the first support arm and the second support arm of the front mounting bracket extend downward below a bottom surface of the front facing flange.

5. The cabinet organizer assembly of claim 1, wherein the first support arm and the second support arm of the front mounting bracket each include two threaded holes.

6. The cabinet organizer assembly of claim 1, wherein the first drawer slide and the second drawer slide are each full-extension, ball bearing telescopic drawer slides.

7. The cabinet organizer assembly of claim 6, wherein the first drawer slide and the second drawer slide each include a cabinet member, an intermediate member, and a drawer member.

8. The cabinet organizer assembly of claim 7, wherein the first drawer slide and the second drawer slide each includes two mounting holes at a front of the respective cabinet member.

9. The cabinet organizer assembly of claim 7, wherein the first drawer slide and the second drawer slide each includes two mounting holes at a rear of the respective cabinet member.

10. The cabinet organizer assembly of claim 9, wherein the two mounting holes at the rear of the cabinet member are horizontally elongated.

11. The cabinet organizer assembly of claim 1, wherein the rear mounting face includes at least two mounting holes.

12. The cabinet organizer assembly of claim 1, wherein the first mounting arm and the second mounting arm of the rear mounting bracket each include two threaded holes.

13. The cabinet organizer assembly of claim 1, wherein the organizer is a drawer.

14. The cabinet organizer assembly of claim 1, wherein the organizer is a shelf.

15. The cabinet organizer assembly of claim 1, wherein the organizer includes a plurality of holes adapted for receiving objects to be stored in the organizer.

16. The cabinet organizer assembly of claim 1, wherein the series of at least two mounting bosses corresponding to each mounting tab includes three mounting bosses for each mounting tab.

17. The cabinet organizer assembly of claim 16, wherein each of the mounting bosses in each series of three mounting bosses is spaced ⅜ inches from each adjacent mounting boss.

18. The cabinet organizer assembly of claim 16, wherein each of the mounting bosses in each series of three mounting bosses is spaced 8 millimeters from each adjacent mounting boss.

* * * * *